US007845882B2

(12) United States Patent
Lawler et al.

(10) Patent No.: US 7,845,882 B2
(45) **Date of Patent: *Dec. 7, 2010**

(54) SUBSEA SUCTION PILE CRANE SYSTEM

(75) Inventors: Kinton Lawler, Houston, TX (US); Dick Vuyk, The Woodlands, TX (US); Richard W. McCoy, Jr., Cypress, TX (US)

(73) Assignee: Oceaneering International Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/612,956

(22) Filed: Nov. 5, 2009

(65) Prior Publication Data

US 2010/0086364 A1 Apr. 8, 2010

Related U.S. Application Data

(63) Continuation of application No. 12/196,854, filed on Aug. 22, 2008, now Pat. No. 7,635,239.

(60) Provisional application No. 60/957,933, filed on Aug. 24, 2007.

(51) Int. Cl.
*E02D 5/74* (2006.01)
*B63B 21/27* (2006.01)
*E02D 7/20* (2006.01)

(52) U.S. Cl. ..... 405/224.1; 405/224; 405/226; 405/228

(58) Field of Classification Search ..... 405/224, 405/224.1, 226, 228, 195.1, 196
See application file for complete search history.

(56) References Cited

U.S. PATENT DOCUMENTS 2,771,747 A 11/1956 Rechtin
4,151,393 A 4/1979 Fenneman et al.
4,179,233 A 12/1979 Bromell et al.
4,892,202 A 1/1990 Hey et al.
4,943,187 A 7/1990 Hopper
5,253,606 A 10/1993 Ortelli
6,601,649 B2 8/2003 Beato et al.
6,910,831 B2 6/2005 Raines
7,635,239 B2 * 12/2009 Lawler ..... 405/224.1
2003/0167659 A1 9/2003 Raines
2006/0065180 A1 3/2006 Raines (Continued)

FOREIGN PATENT DOCUMENTS

CN 201347191 * 11/2009

(Continued)

*Primary Examiner*—Frederick L Lagman
(74) *Attorney, Agent, or Firm*—Duane Morris LLP

(57) ABSTRACT

A subsea suction pile crane system comprises a suction pile and a crane mounted on the suction pile. The crane comprises a rotatable mounting surface, a winch, and a boom having a proximal section attached to the rotatable mounting surface such that the boom can pivot with respect to the mounting surface, and a distal section opposite the proximal section. In embodiments, a plurality of suction piles may be sed. The crane system is typically hydraulically operated. A preferred embodiment of the invention may further comprise a remotely operated vehicle comprising a hydraulic power supply operatively coupled to the crane, and a manipulator arm mounted on the distal section of the boom and operatively coupled to the hydraulic power supply.

12 Claims, 12 Drawing Sheets

U.S. PATENT DOCUMENTS

| | | | | |
|---|---|---|---|---|
| 2006/0140726 | A1 | 6/2006 | Pollack et al. | |
| 2006/0201679 | A1 | 9/2006 | Williams | |
| 2007/0034379 | A1 | 2/2007 | Fenton et al. | |
| 2009/0129870 | A1 | 5/2009 | Jones | |
| 2010/0086364 | A1 * | 4/2010 | Lawler et al. | 405/224.1 |

FOREIGN PATENT DOCUMENTS

| | | |
|---|---|---|
| JP | 10280404 | 10/1998 |
| JP | 2001032249 | 2/2001 |

* cited by examiner

SUBSEA SUCTION PILE CRANE SYSTEM

RELATION TO OTHER APPLICATIONS

This application is a continuation of U.S. application Ser. No. 12/196,854 which issued as U.S. Pat. No. 7,635,239 on Dec. 22, 2009 filed Aug. 22, 2008, and claims further priority through U.S. Provisional Application 60/957,933 filed Aug. 24, 2007.

BACKGROUND OF THE INVENTION

Many subsea projects require the ability to safely and accurately lift heavy loads from the seabed. In many cases, the preferred option is to conduct this lifting on the seabed itself, rather than lifting from a surface vessel, since the seabed is stable and can support virtually unlimited loads. In many applications, the weight of the lifting appliance and its payload have to be spread across a large surface of the seabed using large, cumbersome structures known as "mud mats."

Problems exist with simply installing two piles and laying a gantry "beam" across the top, e.g. it is nearly impossible to locate a second pile an exact distance from the first installed pile; it is nearly impossible to install either pile plumb; it is nearly impossible to raise and lower both piles synchronously; and the position of the lifting interface relative to the object to be lifted is nearly impossible to locate exactly when the piles are installed.

SUMMARY OF THE INVENTION

The invention has various embodiments.

In an embodiment, a crane uses a static suction pile as its base.

In another embodiment, a gantry crane uses a plurality of static suction piles as its base.

In another embodiment, a crane uses a dynamic (moveable) suction pile both as its base and its primary mechanism for vertical movement.

In another embodiment, a gantry crane uses a plurality of dynamic (moveable) suction piles as its base and its primary mechanism for vertical movement.

Additionally, a control system is disclosed for controlling a gantry crane system which relies on a plurality of dynamic (moveable) suction piles as its base and its primary mechanism for vertical movement.

For example, in an embodiment, a subsea suction pile crane system comprises a suction pile and a crane mounted on the suction pile. In this embodiment, the crane comprises a rotatable mounting surface, a winch, and a boom having a proximal section attached to the rotatable mounting surface such that the boom can pivot with respect to the mounting surface, and a distal section opposite the proximal section. In a preferred embodiment, the crane system is hydraulically operated.

A preferred embodiment of the invention may further comprise a remotely operated vehicle comprising a hydraulic power supply operatively coupled to the crane, and a manipulator arm mounted on the distal section of the boom and operatively coupled to the hydraulic power supply.

DESCRIPTION OF THE DRAWINGS

Various embodiments of the inventions disclosed herein are illustrated in the Figures as discussed herein below.

DESCRIPTION OF PREFERRED EMBODIMENTS

Figure 1:
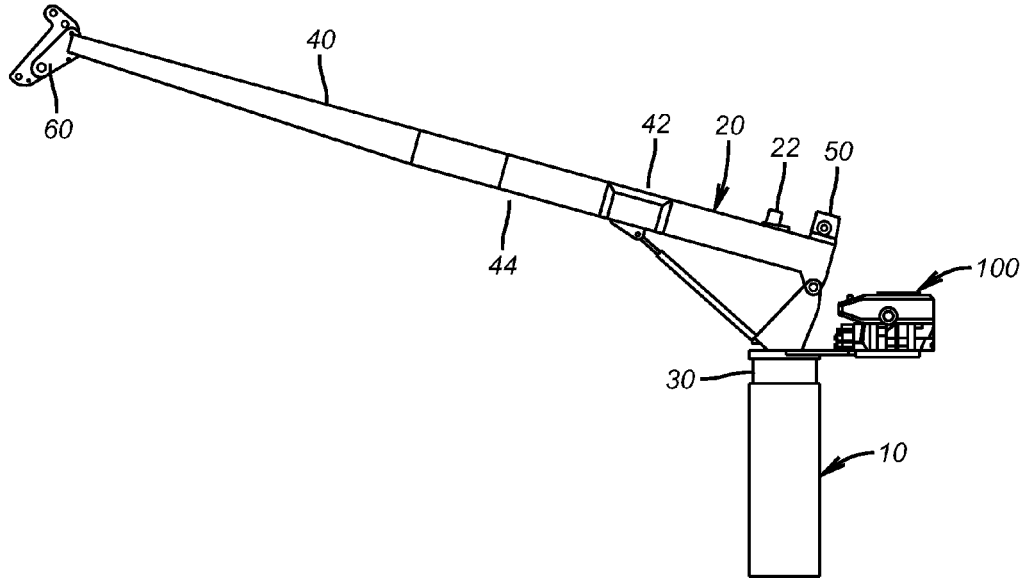
FIGS. 1-6 illustrate a first embodiment of the invention.
Figure 2:
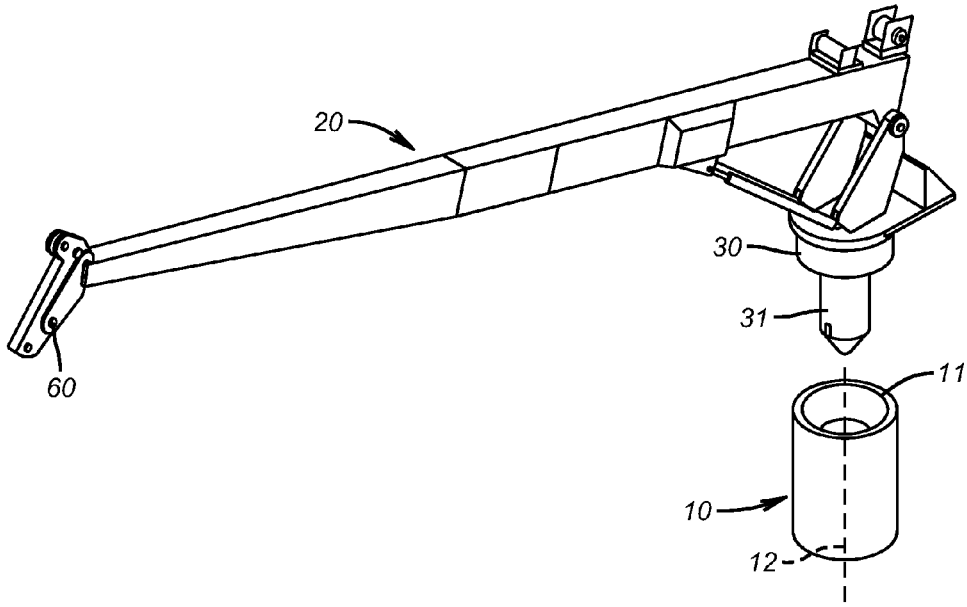
Figure 3:
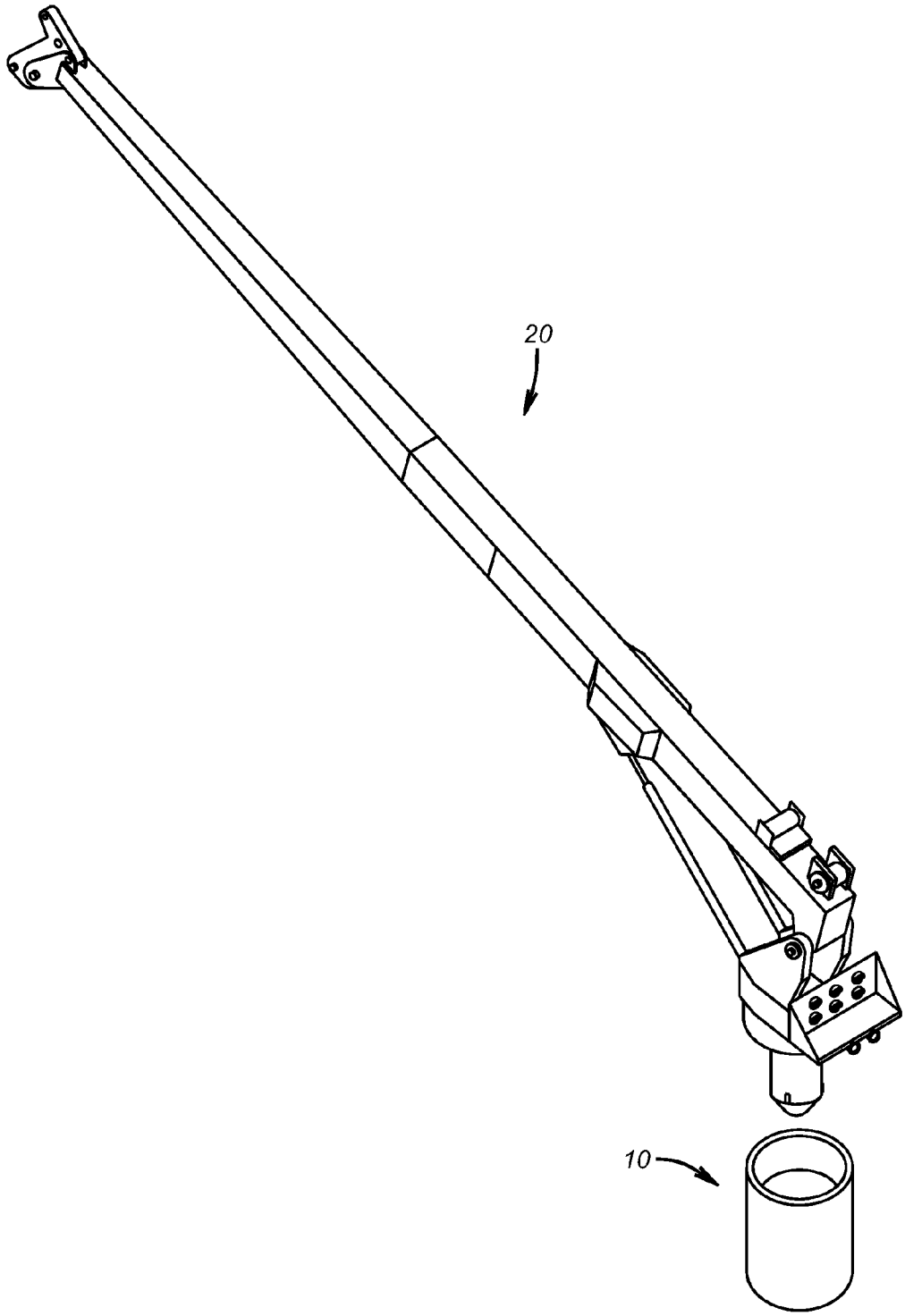
Figure 4:
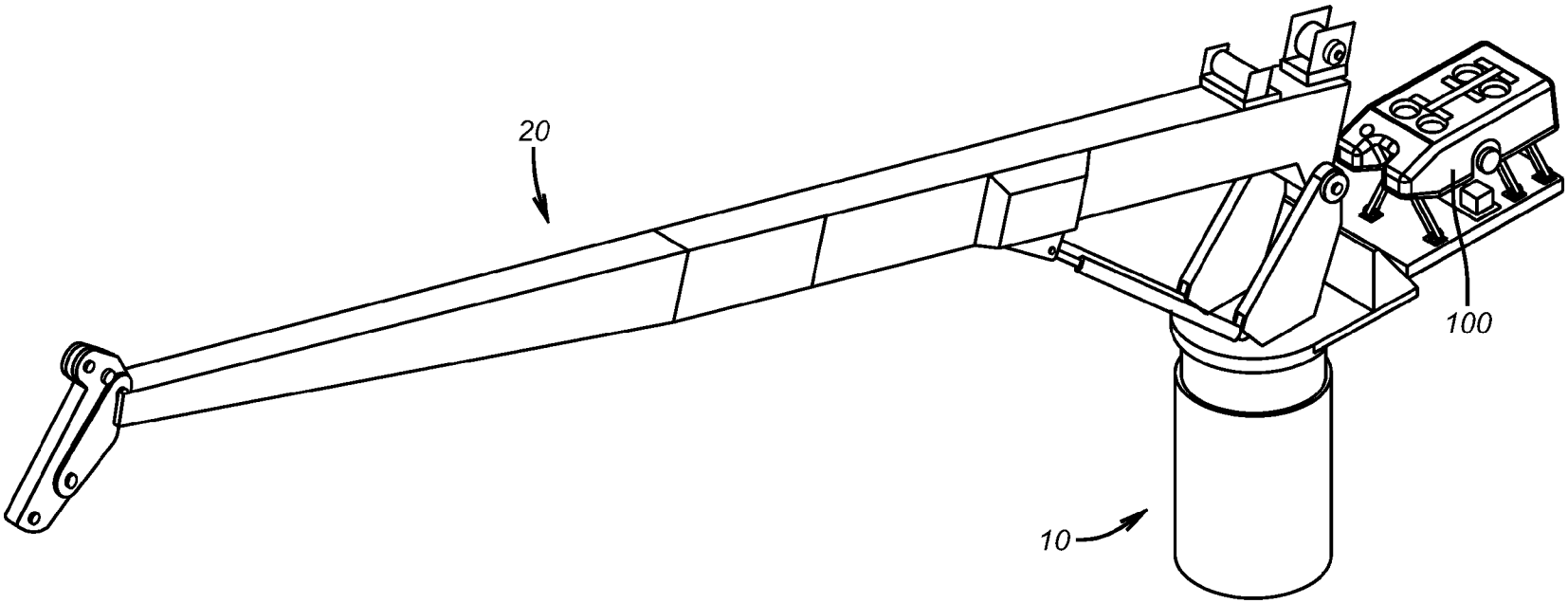
Figure 5:
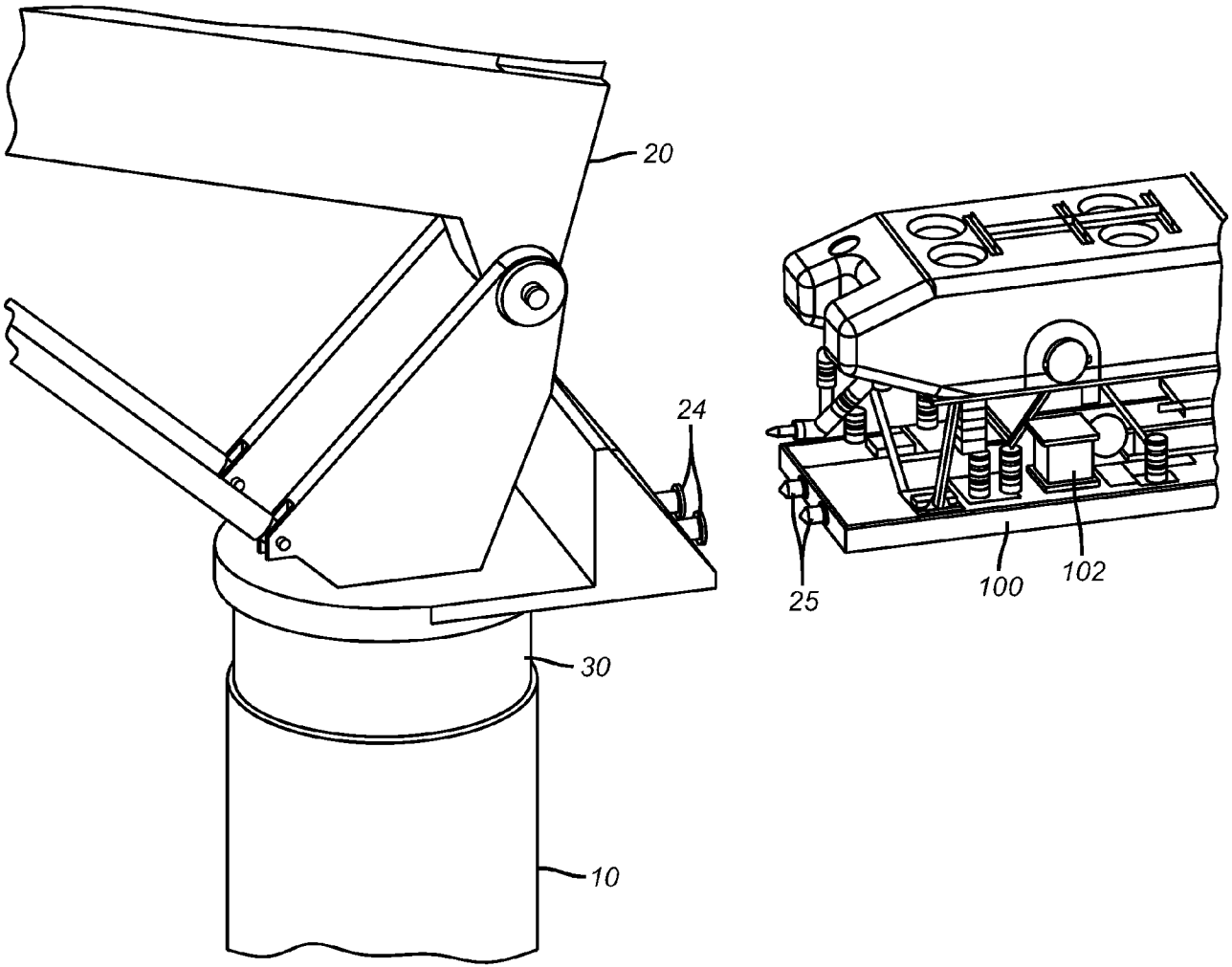
Figure 6:
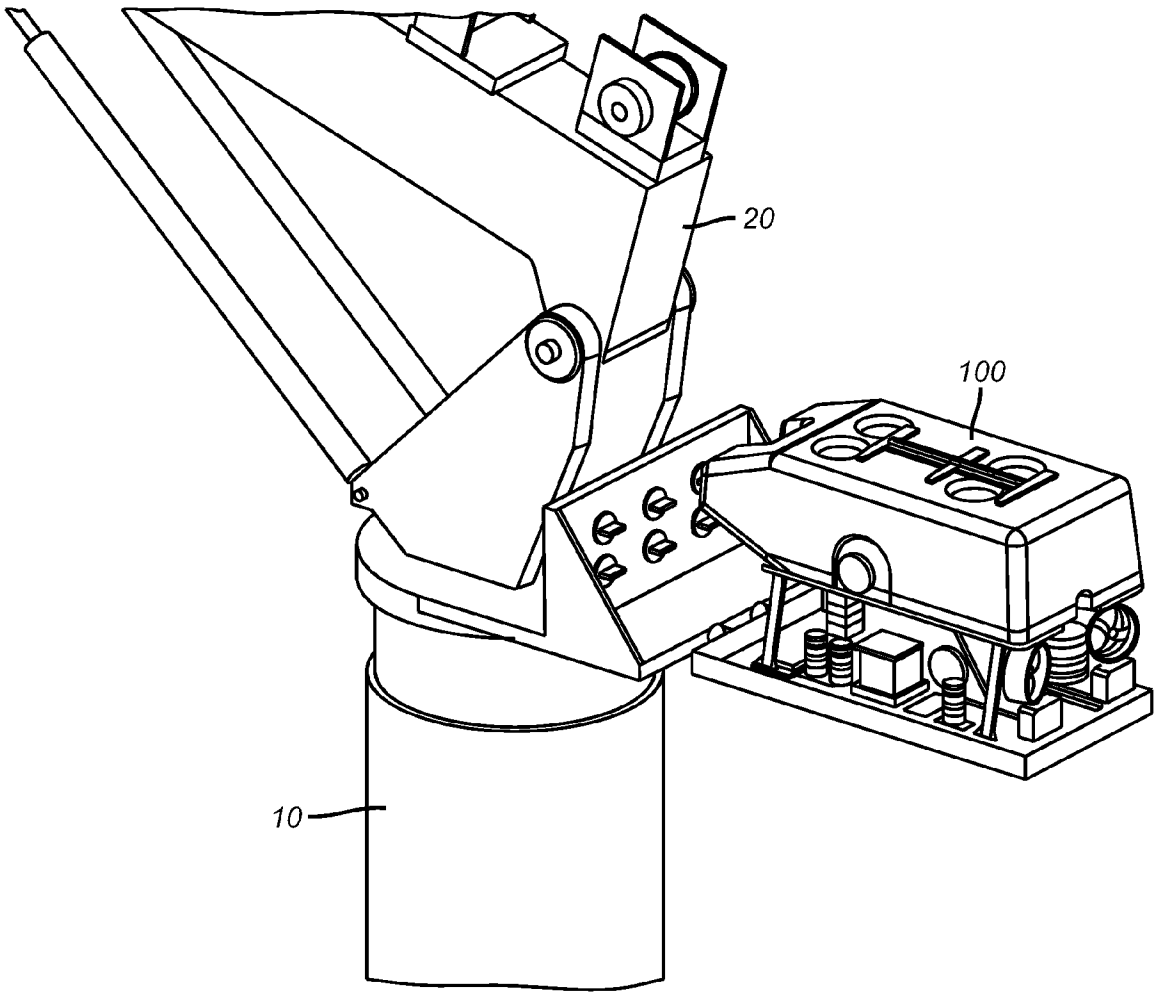
Figure 7:
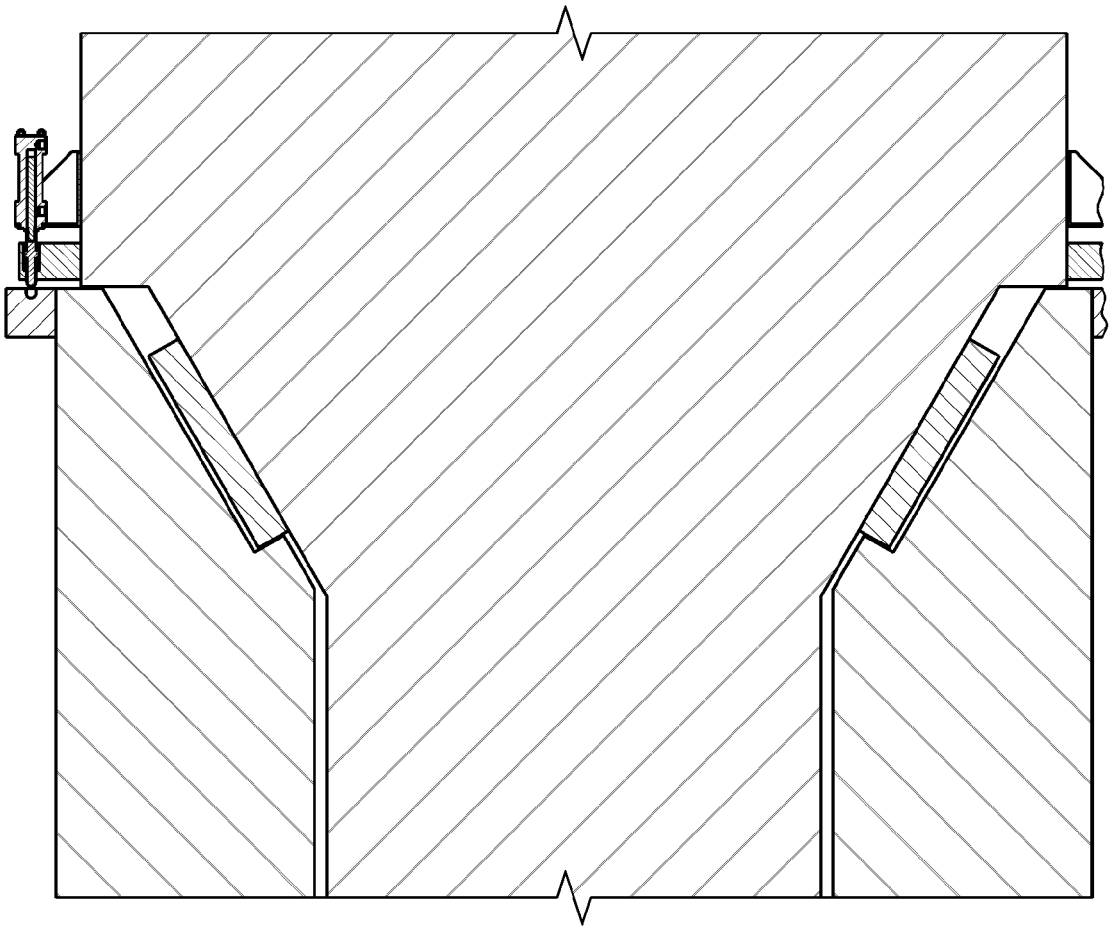
FIG. 7-10 illustrate docking and rotation mechanisms including bearing and turret lock.
Figure 8:
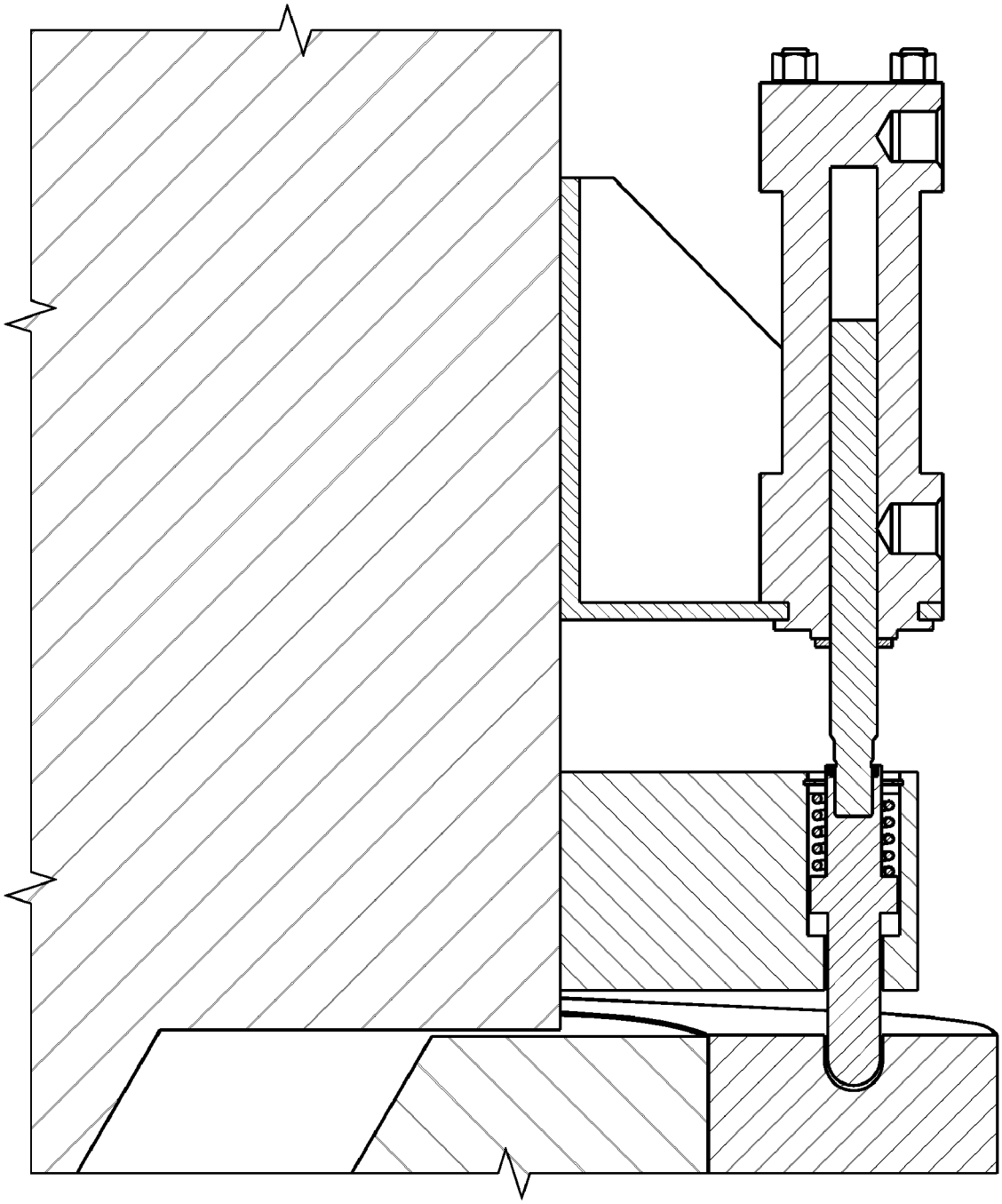
Figure 9:
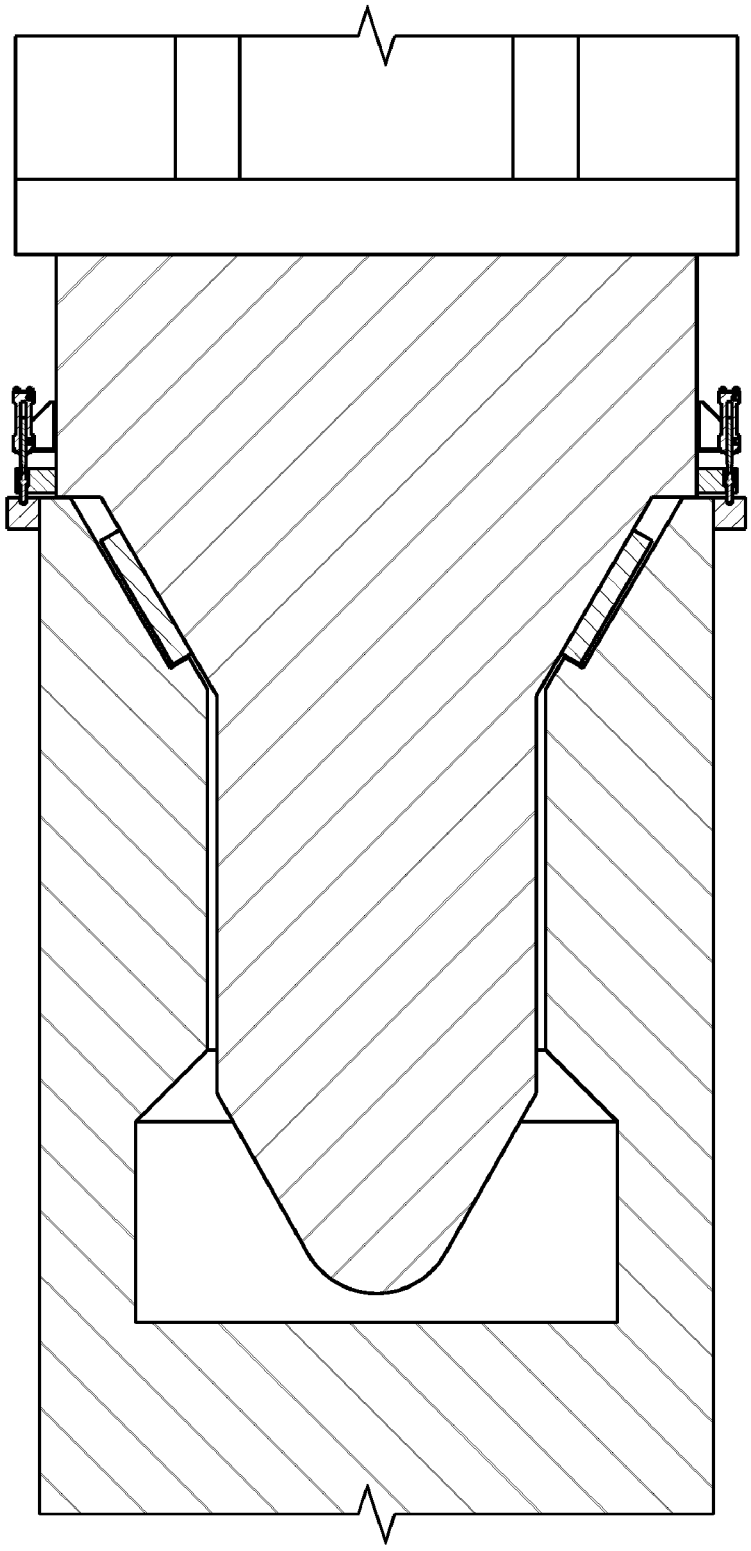
Figure 10:
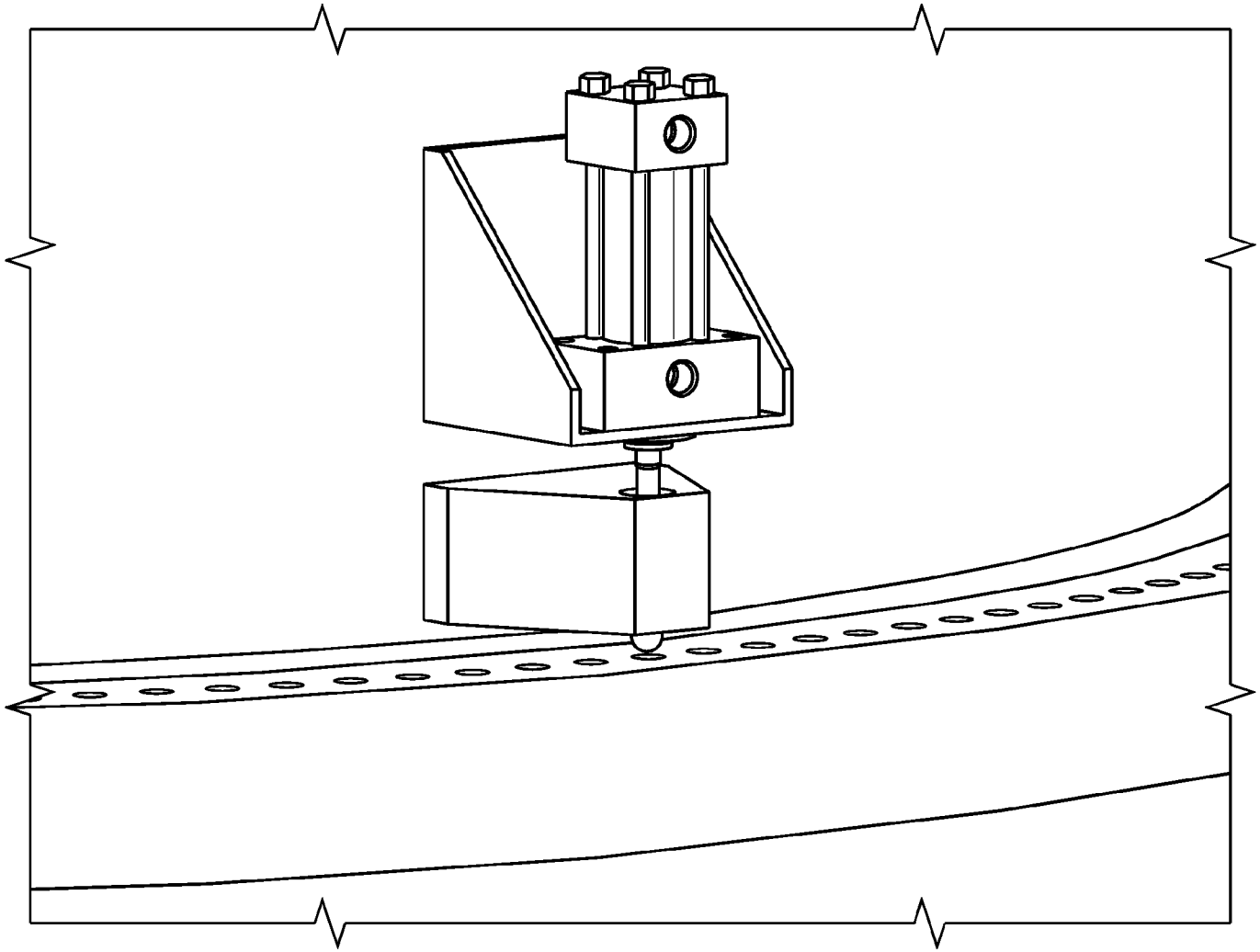

Referring now to FIGS. 1-6, in a first embodiment subsea crane system 1 comprises suction pile 10 and crane 20 rotatably mounted on suction pile 20.

Suction pile 10 is adapted for use subsea and has top surface 11 (FIG. 2) which can accept crane 20.

Crane 20 comprises rotatable mounting surface 30; boom 40 having proximal section 42 attached to rotatable mounting surface 30 such that boom 40 can pivot with respect to mounting surface 30; winch 50 operatively mounted on boom 40; and distal section 44 opposite proximal section 42. Crane 20 is adapted for use subsea and has a weight supportable by suction pile 10 when both are disposed subsea.

Mounting surface 30 is preferably a turret which may allow rotation around vertical axis 12, e.g. an axis along the length of pile 10. In typical environments, crane 20 is fixed into place atop suction pile 10 such as by using pivot 31 which is matable into suction pile 10.

In a preferred embodiment, crane 20 is hydraulically operated and may comprise hydraulic power source 22. Typically, crane 20 houses all required controls to keep the base as simple as possible.

In certain embodiments, remotely operated vehicle (ROV) 100 comprises a hydraulic power supply operatively coupled to crane 20 to provide a source of hydraulic power to crane 20. For example, one or more hydraulic couplings 24 (FIG. 4) may be present and fluidly in communication with hydraulic power supply 22. ROV 100 may use hydraulic couplings 24 to operatively couple to crane 20 to provide a source of hydraulic power to crane 20. In some embodiments, hydraulic couplings 24 operatively couple with complementary couplings 25 (FIG. 4) on ROV 100 which comprises either second hydraulic power supply 102 to provide a source of hydraulic power to hydraulic power supply 22 of crane 20 or to provide the sole source of hydraulic power for crane 20.

Manipulator arm 60 may be mounted on distal section 44 of boom 40 and operatively coupled to a hydraulic power supply 22.

Figure 11A:
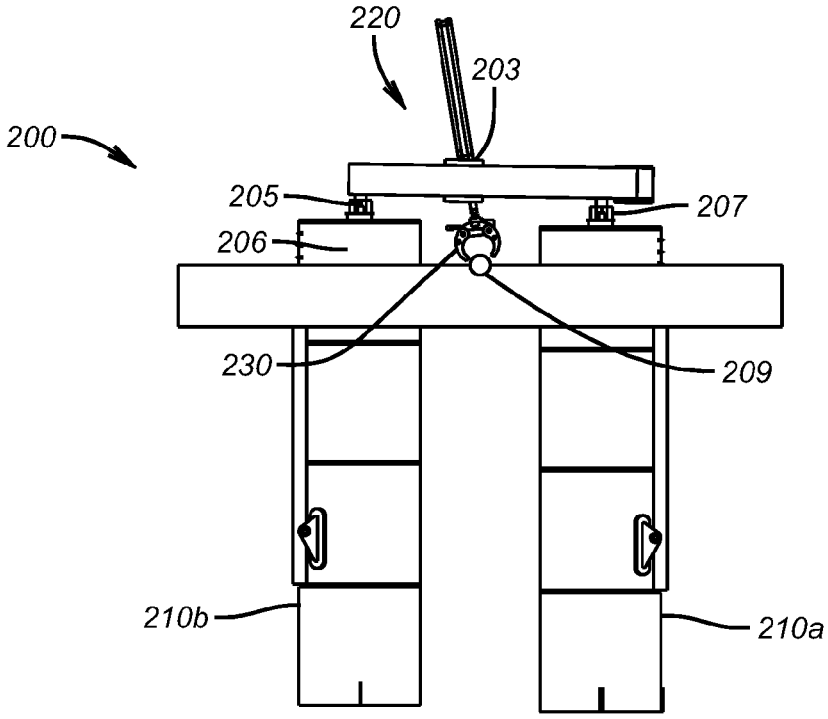
FIGS. 11*a*, 11*b*, and 12 illustrate an exemplary dual suction pile system.
Figure 11B:
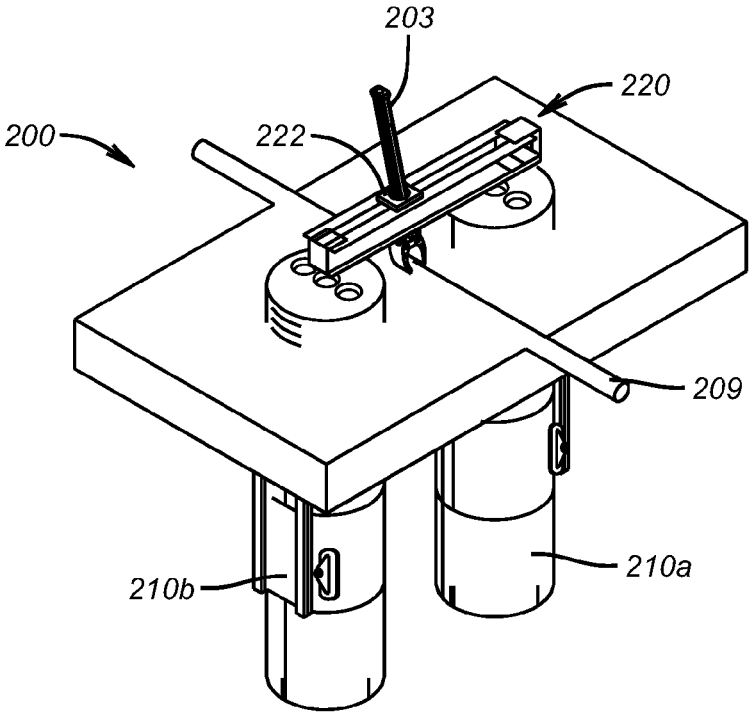
Figure 12:
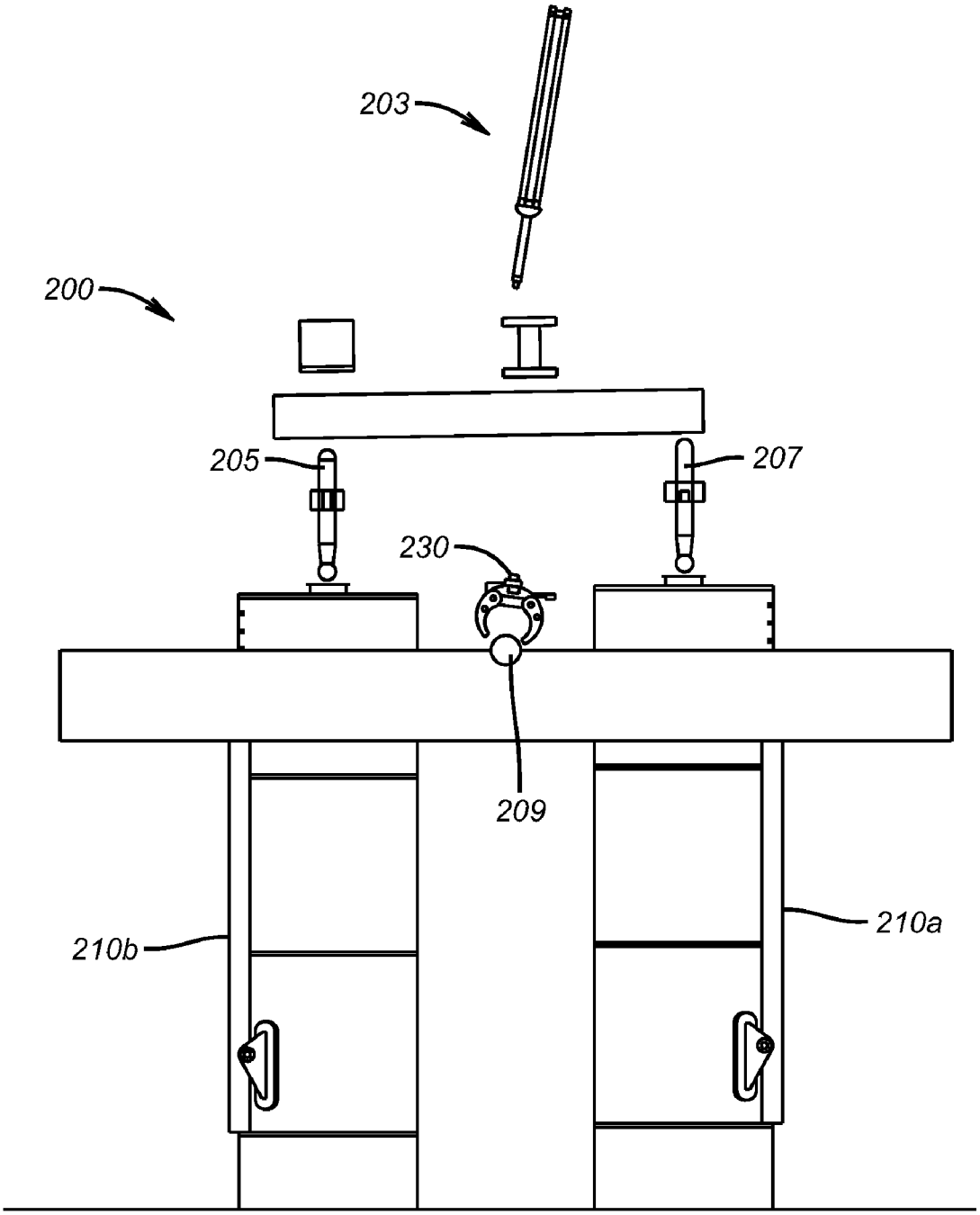
Figure 13A:
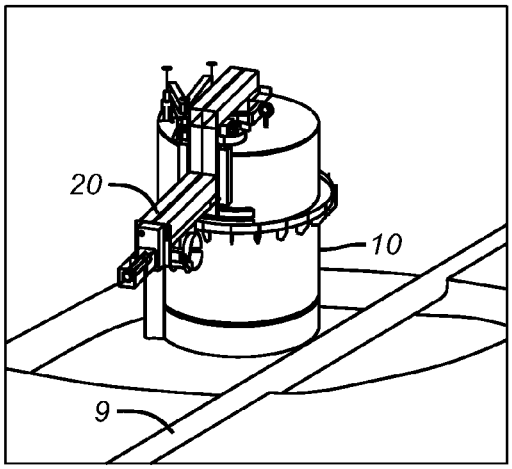
FIGS. 13*a*-13*d* illustrate an exemplary use of a dynamic suction pile embodiment.
Figure 13B:
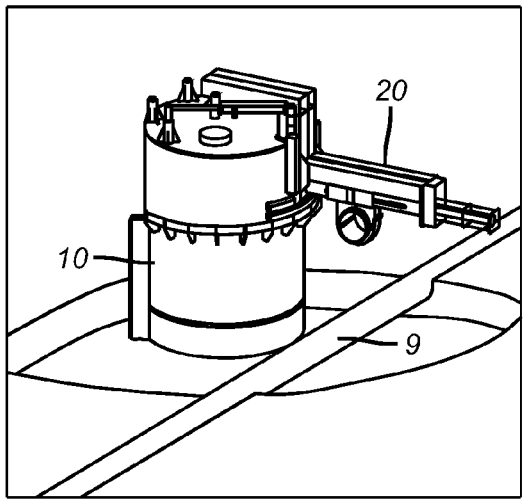
Figure 13C:
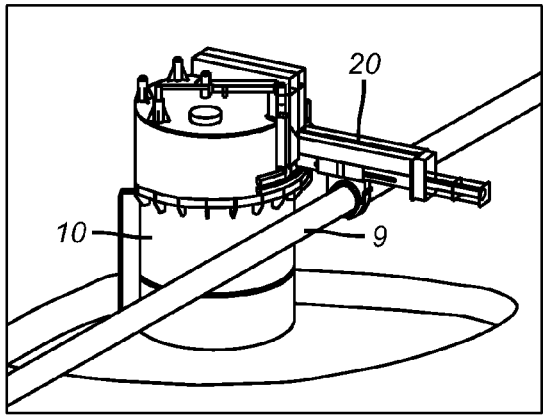
Figure 13D:
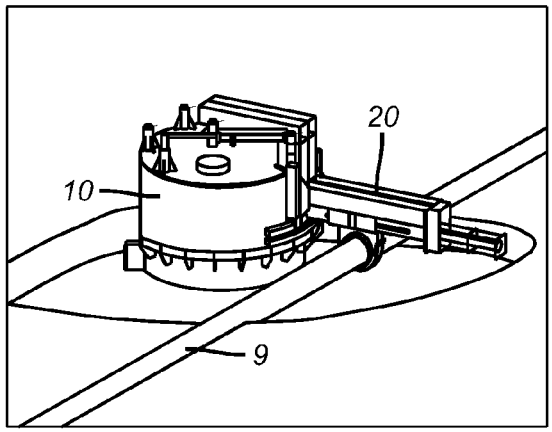

In further embodiments, illustrated in FIGS. 11*a*, 11*b*, and 12, a plurality of piles 210*a*, 210*b* are used. In these configurations, the load that can be carried, e.g. object 209, may be increased and stability provided that cannot be accomplished with a single pile 10 (FIG. 1). System 200 may further provide a supporting structure for a "gantry" type crane, 220. As with the previously described system, piles 210*a*, 210*b* can be static or dynamic.

In a currently preferred embodiment for multiple suction piles, system 200 comprises two piles, 210*a* and 210*b*. Removable installation post 207 may be installed in first pile 210*a*. Rotation mechanism 203 will allow rotation of gantry 220 to accommodate variations in pile height as well as differences in pile verticality. In an embodiment, only one degree-of-freedom is required by this structure. However, the structure may have one or more additional degrees-of-freedom, e.g. via gimbal 205.

In certain embodiments, removable post 205 is installed in second pile 210*b*. Post 205 may receive gimbaled structure 203 which allows rotation in two planes. Post 205 itself may be allowed to rotate.

Traveler 222 (FIG. 11*b*) may be present to allow gimbaled structure 203 to traverse along the length of gantry 220 to allow for variances in the distance between the installed seabed suction piles 210*a*, 210*b* and/or changes in the length of the gantry system 220 necessary to accommodate increased or decreased changes in the distance between attachments point as piles 210*a*, 210*b* are raised and lowered relative to each other.

Fine control of lifting interface 230 is afforded by a lift mechanism such as gimbaled structure 203 which can traverse along the length of gantry 220 and can also raise and lower the lifting interface 230. Lifting interface 230 can include, e.g., tongs, grippers, hooks, and the like, or combinations thereof. Lifting interface 230 may be allowed to hang vertically by virtue of gimbaled structure 203. Additionally, lifting interface 230 can be rotated to align itself with the object to be lifted if necessary.

In the embodiment illustrated in FIGS. 11*a*, 11*b*, and 12, lifting interface 230 is a tong which may be aligned to pipeline 209 to allow pipeline 209 to be lifted. In certain embodiments, lifting mechanism 203 is not required.

In the operation of a preferred embodiment, referring back to FIGS. 1-6, crane 20 may be used subsea by locating suction pile 10 subsea and then positioning crane 20 on top of suction pile 10 subsea. Crane 20 may further be secured on top of suction pile 10 subsea. Typically, gravity will keep crane 20 on the mounting surface of suction pile 10 which will act as a base for crane 20. In most embodiments, a center pole such as pivot 11 (FIG. 2) will stab down into the base of suction pile 10 to address a cantilevered load. In certain embodiments, the positioning, and possibly securing, occurs before suction pile 10 is lowered subsea.

As noted above, crane 20 may be powered hydraulically, either with its own source of hydraulic fluid, by ROV 100 coupled to crane 20 such as with hydraulic couplings 24 (FIG. 4), or a combination of the two. Where ROV 100 is used, either solely or in combination with hydraulic power supply 22, ROV 100 is positioned proximate crane 20 and coupled to crane 20 via hydraulic connector 24. This provides a hydraulic conduit operatively in fluid communication between ROV 100 and a hydraulically operated crane 20. Once coupled, ROV 100 supplies hydraulic fluid to hydraulically operated crane 20 through the hydraulic conduit. This hydraulic fluid comes from a source of hydraulic fluid on ROV 100.

Control of suction piles 10, e.g. in embodiments using dynamic suction piles, may further comprise raising one or more of the suction piles to which crane 20 is mounted. In embodiments of a plurality of suction piles, e.g. FIGS. 11*a*, 11*b*, and 12, piles 210*a* and 210*b* may be raised or lowered independently or simultaneously. This may be accomplished, e.g., by a device that monitors the elevation (relative to seafloor or using water pressure) of both suction piles 210*a*, 210*b* and can control the volume and pressure of water entering or leaving each suction pile 210*a*, 210*b* to control elevation of each suction pile 210*a*, 210*b*. By pumping water out of one or both of suction piles 210*a*, 210*b*, suction piles 210*a*, 210*b* and their associated lifting appurtenances, e.g. crane 220, as well as the load, e.g. 209, can be lowered. Conversely, pumping water into one or both of suction piles 210*a*, 210*b* accomplishes the opposite, a lifting action. Similarly, a single suction pile 10, as illustrated in FIGS. 13*a*-13*d*, may be raised and/or lowered, thereby raising or lowering an object such as pipeline 9. Control of the pumping may be directly or indirectly achieved from ROV 100.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A subsea crane system, comprising:

a. a height controllable subsea suction pile, the subsea suction pile dimensioned and configured to be controllably raised or lowered with respect to a seabed;

b. a platform mounted on the controllable subsea suction pile; and c. a controllable crane mounted on the platform.

2. The subsea crane system of claim 1, further comprising a manipulator attached to a predetermined end of the controllable crane.

3. The subsea crane system of claim 1, wherein the controllable subsea suction pile comprises a plurality of controllable subsea suction piles.

4. The subsea crane system of claim 2, further comprising:

a. a plurality of mounts mounted on the platform; and b. a second platform attached to a predetermined number of the plurality of mounts;

c. wherein the controllable crane is attached to the second platform.

5. The subsea crane system of claim 4, wherein the controllable crane is movably attached to the second platform.

6. The subsea crane system of claim 1, wherein the height controllable subsea suction pile is at least one of a static subsea suction pile or a dynamic subsea suction pile.

7. The subsea crane system of claim 1, wherein the crane is a gantry crane.

8. A method of using a crane subsea, comprising:

a. positioning a controllable suction pile subsea at a predetermined location, the suction pile comprising a top section;

b. attaching a platform to the controllable suction pile;

c. attaching a crane to the top section of the suction pile subsea; and d. adjusting the position of the controllable suction pile subsea to a desired location relative to a seabed in a predetermined plane.

9. The method of claim 8, wherein locating the controllable suction pile subsea further comprises:

a. locating a subsea structure to be manipulated by the crane; and b. installing the controllable suction pile at a distance near the subsea structure at which the subsea structure can be operatively reached by the crane.

10. The method of claim 9, further comprising:

a. attaching a manipulator to an end of the crane;

b. adjusting a height of the controllable suction pile to a first height relative to the seabed such that the manipulator is positioned proximate the subsea structure;

c. securing the subsea structure in the manipulator.

11. The method of claim 10, further comprising adjusting the height of the controllable suction pile to a second height after the manipulator secures the subsea structure.

12. The method of claim 8, wherein the suction pile is a plurality of suction piles, further comprising movably attaching the crane to the top section of a first suction pile of the plurality of suction piles.

* * * * *